US006759955B2

(12) United States Patent
Koneff et al.

(10) Patent No.: US 6,759,955 B2
(45) Date of Patent: Jul. 6, 2004

(54) DOORBELL SYSTEM

(75) Inventors: John A. Koneff, Hudson, OH (US); Wei Gene Kenneth Shen, Mongkok (HK); Kam Wong Wong, Tsuen Wan (HK)

(73) Assignee: The Lamson & Sessions Co., Cleveland, OH (US)

( * ) Notice: Subject to any disclaimer, the term of this patent is extended or adjusted under 35 U.S.C. 154(b) by 123 days.

(21) Appl. No.: 10/016,278

(22) Filed: Oct. 30, 2001

(65) Prior Publication Data

US 2003/0080855 A1 May 1, 2003

(51) Int. Cl.[7] ..... G08B 1/08

(52) U.S. Cl. ..... 340/539.1; 340/691.1; 340/692; 116/148

(58) Field of Search ..... 340/539.1, 691.1, 340/328, 326, 392.1, 384.7, 692.6, 825.36; 116/148, 155; 379/167.05

(56) References Cited

U.S. PATENT DOCUMENTS

| | | | | | |
|---|---|---|---|---|---|
| 4,326,276 | A | * | 4/1982 | Scott, Jr. | 368/10 |
| 4,523,193 | A | | 6/1985 | Levinson et al. | 340/825.69 |
| 4,868,540 | A | * | 9/1989 | Housley | 340/326 |
| 5,148,468 | A | | 9/1992 | Marrick et al. | 379/56 |
| 5,210,520 | A | | 5/1993 | Housley | 340/326 |
| 5,365,214 | A | | 11/1994 | Angott et al. | 340/328 |
| 5,475,369 | A | | 12/1995 | Baker | 340/573 |
| 5,564,294 | A | * | 10/1996 | Chen | 70/1 |
| 5,568,122 | A | | 10/1996 | Xydis | 340/539 |
| 5,570,083 | A | * | 10/1996 | Johnson | 340/695 |
| 5,583,477 | A | * | 12/1996 | Yen | 340/328 |
| 5,648,753 | A | | 7/1997 | Martin | 340/324.1 |
| 5,657,380 | A | | 8/1997 | Mozer | 379/88 |
| 5,680,102 | A | | 10/1997 | Xydis | 340/539 |
| 5,680,112 | A | | 10/1997 | Xydis | 340/636 |
| 5,774,039 | A | | 6/1998 | Housley | 340/326 |
| 5,894,262 | A | | 4/1999 | McCavit et al. | 340/328 |
| 5,973,591 | A | | 10/1999 | Schwartz et al. | 340/394.7 |
| 6,175,298 | B1 | | 1/2001 | Xydis | 340/392.1 |
| 6,246,927 | B1 | | 6/2001 | Dratman | 700/246 |
| 6,252,495 | B1 | | 6/2001 | Nakamura | 340/328 |

OTHER PUBLICATIONS

Undated catalog, "Wireless Chimes," Dimango pp. 1–9 and cover, title page, and back cover.
Brenwin, "Talki–Chime," GW:TC Presentation, pp. 1–4 and front page, 1999.

* cited by examiner

*Primary Examiner*—Benjamin C. Lee
*Assistant Examiner*—Phung Nguyen
(74) *Attorney, Agent, or Firm*—Jones Day

(57) ABSTRACT

A doorbell system includes first and second pushbutton and an RF transmitter activatable by the first and second pushbutton. An RF receiver is configured to receive RF signals from the RF transmitter. The doorbell system further includes a microphone. A first storage device of the doorbell system stores a first sound. A second storage device is configured to record a second sound through the microphone. A playback device is operatively associated with the RF receiver and the storage devices to enable a user to select one of the sounds by pressing the first pushbutton and to play the selected one of the sounds by pressing the second pushbutton.

10 Claims, 3 Drawing Sheets

DOORBELL SYSTEM

FIELD OF THE INVENTION

The present invention relates to doorbell systems.

BACKGROUND

Doorbell systems are used to notify an occupant of a house that a visitor is at a door of the house. The notification is achieved by the visitor activating the doorbell system to play a sound to be heard by the occupant.

SUMMARY

The claimed invention provides a doorbell system including first and second pushbuttons and an RF transmitter activatable by the first and second pushbuttons. An RF receiver is configured to receive RF signals from the RF transmitter. The doorbell system further includes a microphone. A first storage device of the doorbell system stores a first sound. A second storage device is configured to record a second sound through the microphone. A playback device is operatively associated with the RF receiver and the storage devices to enable a user to select one of the sounds by pressing the first pushbutton and to play the selected one of the sounds by pressing the second pushbutton.

In a preferred embodiment of the claimed invention, the first pushbutton, the second pushbutton and the RF transmitter are interconnected to form an activation unit, and the RF receiver, the microphone, the first and second storage devices, and the playback device are interconnected to form an announcement unit. The activation unit is operable remote from the announcement unit. The playback device is operative in response to the first pushbutton to play a successive one of the sounds each time the first pushbutton is pressed. The successive one of the sounds is based on a cyclically applied sequence of the sounds, in which each of the sounds occurs once in the sequence. The playback device is operative in response to the second pushbutton to play the sound that was last played by the playback device in response to the first pushbutton being pressed.

In accordance with another feature of the claimed invention, the first storage device also stores a third sound. The playback is operative to enable a user to select one of the first, second and third sounds by pressing the first pushbutton, and to play the selected one of the sounds by pressing the second pushbutton.

In accordance with yet another feature of the claimed invention, the second storage device is further configured to record a third sound from a sound generating device through an input terminal. The second storage device is operative in response to a record button to record the second or third sound during the time the record button is pressed. The recording of the second or third sound is recording of the third sound through the terminal if the terminal is connected to the sound generating device, and is recording of the second sound through the microphone if the terminal is not electrically connected to the sound generating device. A playback button is configured to activate the playback device to play the second or third sound that is stored in the second storage device. The announcement unit is configured to have an installed condition mounted on a wall and has a rear surface configured to face the wall when the announcement unit is in the installed condition. The microphone, the terminal, the record button and the play button are accessible through apertures in the rear surface.

DESCRIPTION

Figure 1:
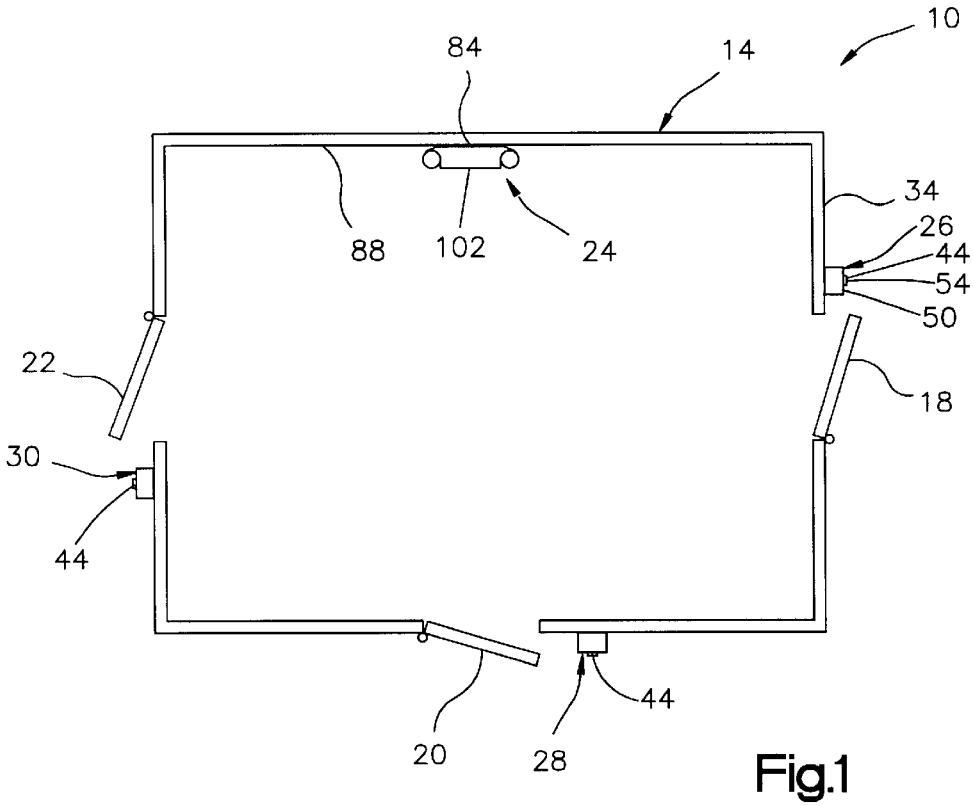
FIG. 1 is a schematic top view of a doorbell system comprising an embodiment of the present invention.

The apparatus 10 shown schematically in FIG. 1 has parts which, as described below, are examples of the elements recited in the claims.

The apparatus 10 is a doorbell system 10 for a building structure 14. The system 10 notifies an occupant that a visitor is at a door of the structure 14 by playing a sound when the visitor activates the system 10. The sound is preselected by the occupant to correspond to a particular door. This enables the occupant to know at which door of the structure the visitor has activated the system 10.

In this particular example, the structure 14 is a house having external doors, including a front door 18, a side door 20 and a back door 22. The doorbell system 10 comprises an announcement unit 24 located within the house 10. The doorbell system 10 further comprises first, second and third activation units 26, 28 and 30 located outside the house 10 and thus remote from the announcement unit 24. The activation units 26, 28 and 30 are preferably affixed to the external surface 34 of the house 14, with each activation unit 26, 28 and 30 being adjacent a different external door 18, 20 and 22. Specifically, the first activation unit 26 is adjacent the front door 18, the second activation 28 unit is adjacent the side door 20, and the third activation unit 30 is adjacent the back door 22.

Figure 2:
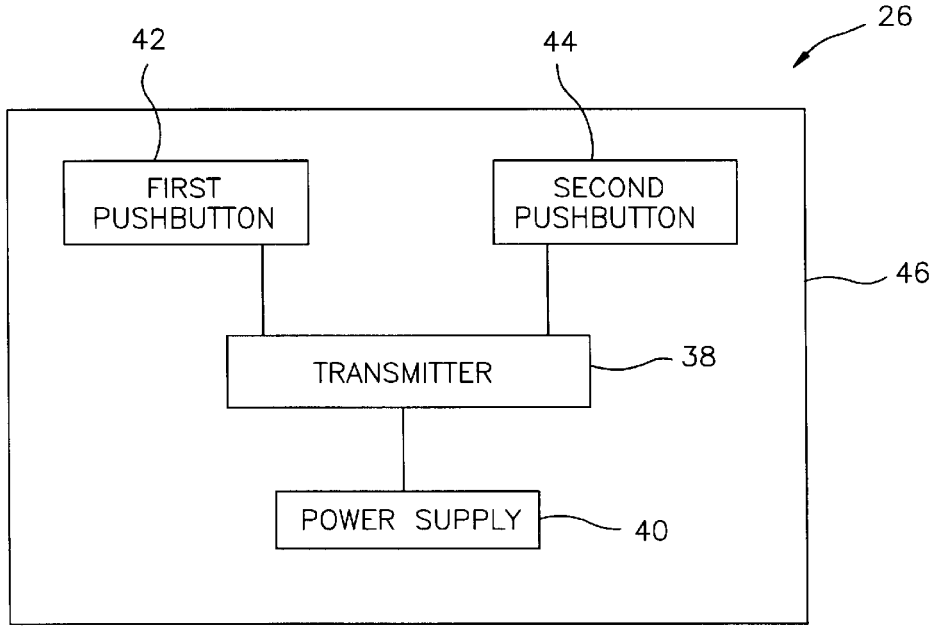
FIG. 2 is a schematic view of an activation unit of the doorbell system of FIG. 1.

The activation units 26, 28 and 30 in this particular example are alike. Each activation unit 26, 28 and 30 has the structure of FIG. 2, shown schematically with reference to the first activation unit 26. The first activation unit 26 includes an RF (radio frequency) transmitter 38 that can transmit an RF signal. The RF signal is selected from first, second and third RF signals. A power supply 40 (preferably batteries) connected in series, provides electrical power to the transmitter 38. First and second pushbuttons 42 and 44 are connected to the transmitter 38 to activate the transmitter 38 to transmit the RF signals. A single housing 46 houses the transmitter 38, the power supply 40 and the pushbuttons 42 and 44.

The transmitter 38 is configured such that each successive time the first pushbutton 42 is pressed, the transmitter 38 transmits a successive one of the RF signals based on a cyclically applied sequence. The sequence is defined by: first signal, second signal, third signal. Each of the three signals occurs once in the sequence. The cycle is a successive repetition of this sequence. The transmitter 38 is also configured such that each time the second pushbutton 44 is pressed, the transmitter 38 transmits the signal that was last transmitted in response to the pressing of the first pushbutton 42. If the second pushbutton 44 is pressed before the first pushbutton 42 has been pressed, the first signal is transmitted.

Figure 3:
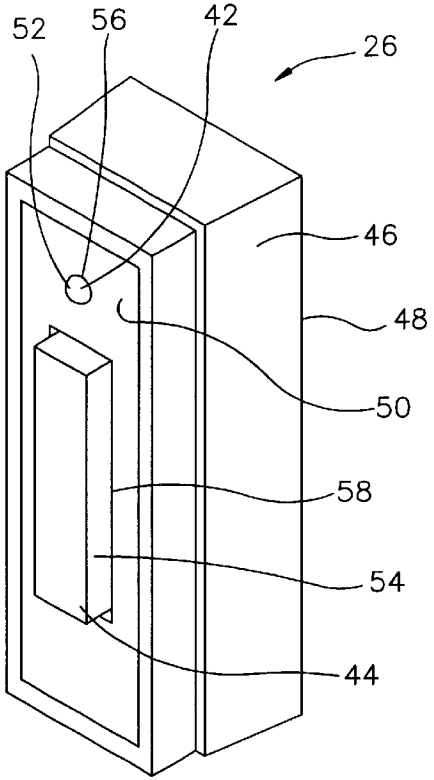
FIG. 3 is a perspective view of the activation unit of FIG. 2.

A perspective view of the first activation unit 26 is shown in FIG. 3. When the activation unit 26 is in installed condition, the housing 46 is fastened to the external surface 34 of the house 14 (FIG. 1). A rear surface 48 of the housing 46 faces the external surface 34 of the house 14. A front surface 50 of the housing 46 faces away from the external surface 34. First and second protruding sections 52 and 54 of the first and second pushbuttons 42 and 44 protrude outward through first and second apertures 56 and 58 in the front surface 50 of the housing 46. The first protruding section 52 differs from the second protruding section 54 in both shape and size. Specifically, the first protruding section 52 is round, whereas the second protruding section 54 is rectangular and larger than the first protruding section 52. Similarly, the first aperture 56 is circular, whereas the second aperture 58 is rectangular and larger then the first aperture 56.

Figure 4:
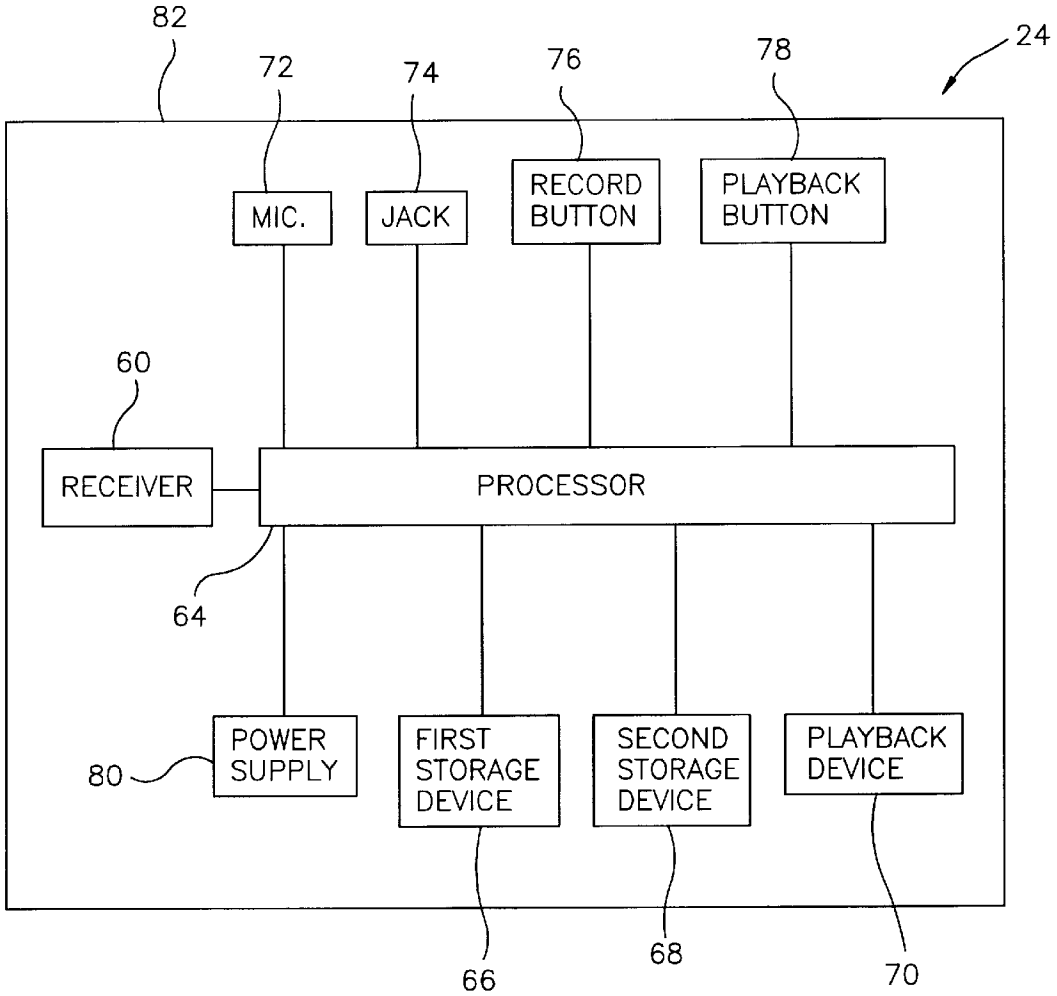
FIG. 4 is a schematic view of an announcement unit of the doorbell system of FIG. 1.

The announcement unit 24 is shown schematically in FIG. 4. The announcement unit 24 has an RF receiver 60 for receiving the RF signals from the transmitter 38 (FIG. 2). The receiver 60 sends data indicative of the received RF signals to a processor 64. The processor 64 controls the operation of first and second sound storage devices 66 and 68 and a playback device 70.

The first sound storage device 66 has permanently stored within it, in digital format, first and second permanent sounds. The first permanent sound is a ding-dong sound. The second permanent sound is a non-vocal tune. The first sound storage device 66 conveys a signal indicative of the first or second permanent sound to the processor 64 when prompted to do so by the processor 64.

The second sound storage device 68 has the ability to record, in digital format, a replaceable sound. The sound is "replaceable" in that the second sound storage device 68 can replace it with a subsequently recorded sound. In fact, the second sound storage device 68 can record a new sound any number times, with each successively recorded sound replacing the previously recorded sound. The replaceable sound can be, for example, music or a verbal message. The verbal message can be, for example, "Someone is at the back door." The second sound storage device 68 conveys a signal indicative of the replaceable sound to the processor 64 when prompted to do so by the processor 64.

The replaceable sound to be recorded in communicated to the second sound storage device 68 by the processor 64. The processor 64 receives the sound from a microphone 72 or an input terminal 74. The input terminal 74 in this example is an input jack. A cable (not shown) can be used to connect the input jack 74 to a sound generating system, such as a tape player. This enables the second sound storage device 68 to record a sound from the sound generating system.

In a known manner, the processor 64 can operate to sense whether or not the input jack 74 is connected to the sound generating device. The processor 64 is configured such that, during recording of the replaceable sound by the second storage device 68, the replaceable sound is conveyed from the input jack 74 if the input jack 74 is connected to the sound generating device. Conversely, the replaceable sound is conveyed from the microphone 72 if the input jack 74 is not connected to the sound generating device.

A record button 76 is operatively connected to the processor 64. Pressing of the record button 76 prompts the processor 64 to activate the second sound storage device 68 to record a new sound from the microphone 72 or the input jack 74 during the time the record button 76 is pressed.

The playback device 70 includes an audio amplifier and a speaker, and is configured to play any sound communicated to it from the processor 64. Thus, any of the sounds stored in the first and second sound storage devices 66 and 68 can be conveyed through the processor 64 to the playback device 70 to be played and heard by the occupant.

A playback button 78 is also operatively connected to the processor 64. Pressing of the playback button 78 prompts the processor 64 to activate the playback device 70 to play the replaceable sound stored in the second sound device 68.

The processor 64 is configured to recognize receipt of the first, second and third RF signals by the receiver 60, and to respond in the following way. The processor 64 associates the first, second and third RF signals with the first permanent sound, the second permanent sound and the replaceable sound, respectively. In response to reception of one of the three RF signals, the processor conveys the sound associated with the received RF signal from the first or second storage device 66 and 68 to the playback device 70. The processor 64 activates the playback device 70 to play the sound.

A power supply 80 provides electrical power to the receiver 60, the processor 64, the first and second sound storage devices 66 and 68, and the playback device 70. In this example, the power supply 80 comprises batteries connected in series.

A single housing 82 houses all of the components of the announcement unit 24. These include the processor 64 and the components connected to the processor 64.

Figure 5:
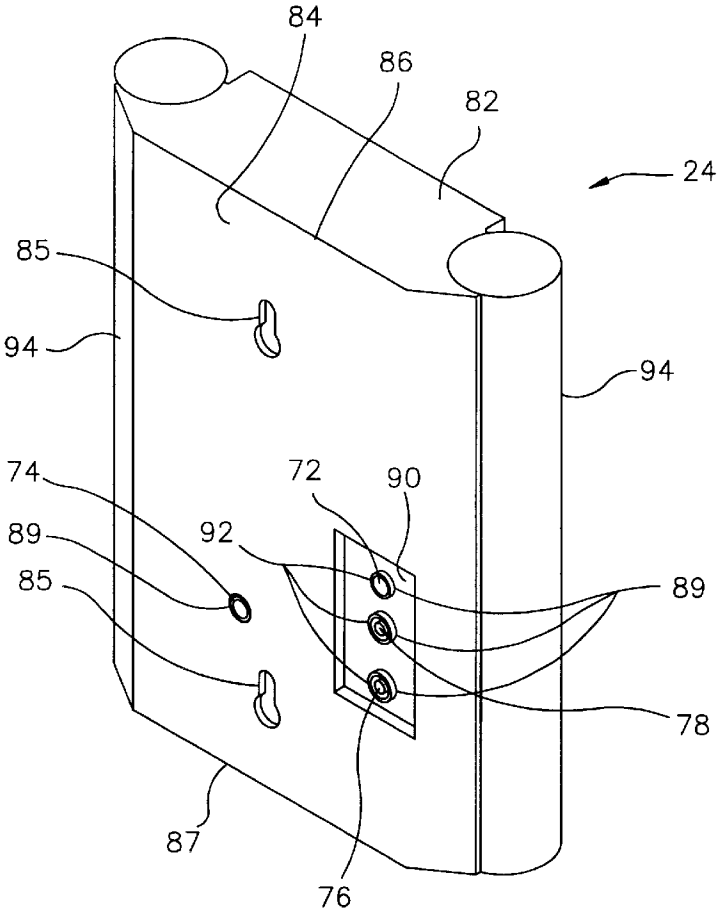
FIG. 5 is a perspective rear view of the announcement unit of FIG. 4.

As shown in FIG. 5, the housing 82 has a rear surface 84 that includes two keyhole slots 85 respectively adjacent the top and bottom edges 86 and 87 of the rear surface 84. The announcement unit 24 has an installed condition mounted on an internal wall 88 of the house 14 (FIG. 1), with the rear surface 84 of the announcement unit 24 facing the internal wall 88. This can be achieved by positioning the keyhole slots 86 over two nails (not shown) protruding from the wall 88 and then letting the announcement unit 24 hang from the nails.

Four apertures 89 in the rear surface 84 of the housing 82 provide access to the microphone 72, the record button 76, the playback button 78, and the input jack 74, respectively. The apertures 89 for the microphone 72, the record button 76, and the playback button 78 are located in a rectangular recessed section 90 of the rear surface 84 and are surrounded by annular ribs 92 protruding from the rear surface 84.

Two tubular housing portions 94 are aligned vertically and located at horizontally opposite sides of the housing 82. Each tubular housing portion 94 contains two batteries of the power supply 80 (FIG. 4), stacked vertically end-to-end.

Figure 6:
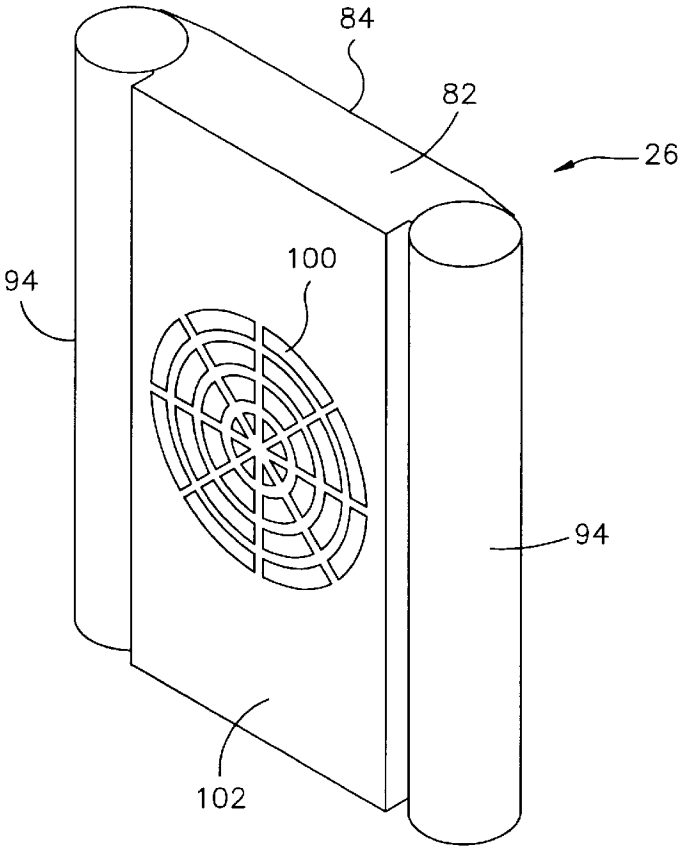
FIG. 6 is a perspective front view of the announcement unit of FIG. 4.

Referring to FIG. 6, the speaker of the playback device 70 is mounted behind an array of apertures 100 in a front face 102 of the housing 83. The speaker is oriented so as to broadcast the sound outward through the apertures 100. The front face 102 can be covered by a decorative façade (not shown). The façade is configured to cover the front face 102 without muffling the sound.

Referring to FIGS. 4 and 5, an example of use of the doorbell system 10 is as follows. To record a replaceable sound, the announcement unit 24 is first removed from the wall 88 (FIG. 1). The occupant presses the record button 76 and conveys a sound into the microphone 72. In this example, the sound is the spoken message "Someone is at the back door." The occupant releases the record button 76 after completing the message. During the period that the record button 76 is pressed, the processor 64 conveys the sound from the microphone 72 to the second sound storage device 68 and activates the second sound storage device 68 to record the sound. The message is stored in place of any sound that may have been previously stored in the second sound storage device 68.

Next, the occupant presses and releases the playback button 78. This activates the processor 64 to convey the replaceable sound from the second sound storage unit 68 to the playback device 70. The playback device 70 audibly plays back the replaceable sound. If the occupant is unsatisfied with the replaceable sound, a new one can be recorded, in the manner described above. However, if the replaceable sound is satisfactory, the announcement unit 24 can be mounted back on the wall 88.

Each of the activation units 26, 28 and 30 can be individually programmed by pressing the first pushbutton 42, to cause a selected one of the sounds to be played by the playback device 70 when the second pushbutton 44 is pressed. This can be accomplished through the following exemplary procedure. The occupant stands by the first activation unit 26 near the front door 18 and presses the first pushbutton 42 of the first activation unit 28 one or more times.

Each time the occupant presses the first pushbutton 42, the transmitter 38 transmits a successive one of the three RF signals based on the repeated sequence described above. The announcement unit 24 receives each RF signal, and, in response, audibly plays the corresponding sound. Thus, in response to each successive pressing of the first pushbutton 42, the announcement unit 24 plays a successive one of the sounds, based on a cyclically applied sequence. The sequence is defined by: first permanent sound, second permanent sound, replaceable sound.

The occupant thus scrolls through the three stored sounds by repeatedly pressing the first pushbutton 42. The occupant stops the scrolling upon hearing the sound that is desired to be associated with this first activation unit 26. The first activation unit 26 is thus programmed to activate playing of the desired one of the three sounds each time the second pushbutton 44 is pressed. More specifically, each time the second pushbutton 44 is pressed, the playback device 70 plays the sound that was last played when the first pushbutton 42 was pressed. In this example, the occupant programs the activation unit 26 to be associated with the first permanent sound, which is the ding-dong sound.

In a similar manner, the second activation 28 unit is programmed to be associated with the second permanent sound, which is the non-vocal tune. Next, in a similar manner, the third activation unit 30 is programmed to be associated with the replaceable sound, which is the message "Someone is at the back door."

Subsequently, a visitor approaches the front door 18, shown in FIG. 1, and presses the second pushbutton 44 of the first activation unit 26. The transmitter 38 (FIG. 2) of the first activation unit 26 transmits the RF signal that was last transmitted upon pressing of the first pushbutton 42 (FIG. 3), which in this case is the first RF signal. Reception of the first signal by the announcement unit 24 activates it to play the first permanent sound, which is the ding-dong sound. Hearing of the ding-dong sound notifies the occupant of the presence of the visitor at the front door 18. This is because the first activation unit 26, located at the front door 18, is the only one of the activation units 26, 28 and 30 that is programmed to play a ding-dong sound.

Similarly, the visitor can approach the side door 20 and press the second pushbutton 44 of the second activation unit 28. In a manner described above, the transmitter 38 of the second activation unit 28 transmits the second RF signal. Reception of the second signal by the announcement unit 24 activates it to play the second permanent sound, which is the tune. Hearing of the tune notifies the occupant of the presence of the visitor at the side door 20. This is because the second activation unit 28, located at the side door 20, is the only one of the activation units 26, 28 and 30 that is programmed to play the tune.

Similarly, the visitor can approach the back door 22 and press the second pushbutton 44 of the third activation unit 30. In a manner described above, the transmitter 38 of the third activation unit 30 transmits the third RF signal. Reception of the third signal by the announcement unit 24 activates it to play the replaceable sound, which is the message "Someone is at the back door." This notifies the occupant that the visitor is at the back door 22.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A doorbell system including:

a first pushbutton;

a second pushbutton;

an RF transmitter activatable by either said first or second pushbuttons;

an RF receiver configured to receive RF signals from said RF transmitter;

a microphone;

a first storage device storing a first sound;

a second storage device configured to record a second sound through said microphone; and a playback device operatively associated with said RF receiver and said storage devices, said playback device being operative to enable a user to select one of said sounds by pressing said first pushbutton and to play the selected one of said sounds by pressing said second pushbutton;

said first pushbutton, said second pushbutton and said RF transmitter being interconnected to form an activation unit of said doorbell system, and said RF receiver, said microphone, said first and second storage devices, and said playback device being interconnected to form an announcement unit of said doorbell system; and said activation unit being operable remote from said announcement unit.

2. A doorbell system as defined in claim 1 wherein said playback device is operative in response to said first pushbutton to play a successive one of said sounds each time said first pushbutton is pressed.

3. A doorbell system as defined in claim 2 wherein said successive one of said sounds is based on a cyclically applied sequence of said sounds, wherein each of said sounds occurs once in said sequence.

4. A doorbell system as defined in claim 1 wherein said playback device is operative in response to said second pushbutton to play the sound that was last played by said playback device in response to said first pushbutton being pressed.

5. A doorbell system as defined in claim 1 wherein said first storage device also stores a third sound, and said playback is operative to enable a user to select one of said first, second and third sounds by pressing said first pushbutton, and to play the selected one of said sounds by pressing said second pushbutton.

6. A doorbell system as defined in claim 1 further comprising an input terminal, said second storage device being further configured to record a third sound from a sound generating device through said input terminal.

7. A doorbell system as defined in claim 6 further comprising a record button, said second storage device being operative in response to said record button to record said second or third sound during the time said record button is pressed.

8. A doorbell system as defined in claim 7 wherein said recording of said second or third sound is recording of said third sound through said terminal if said terminal is connected to said sound generating device, and is recording of said second sound through said microphone if said terminal is not electrically connected to said sound generating device.

9. A doorbell system as defined in claim 8 further comprising a playback button configured to activate said playback device to play the second or third sound that is stored in said second storage device.

10. A doorbell system as defined in claim 9 wherein said announcement unit is configured to have an installed condition mounted on a wall and has a rear surface configured to face the wall when said announcement unit is in said installed condition, and wherein said microphone, said terminal, said record button and said play button are accessible through apertures in said rear surface.

* * * * *